US006332648B1

(12) United States Patent
Aucheron

(10) Patent No.: US 6,332,648 B1
(45) Date of Patent: Dec. 25, 2001

(54) MOTION ROTATING SEAT PARTICULARLY FOR A RAILWAY VEHICLE

(75) Inventor: Roger Aucheron, Aytre (FR)

(73) Assignee: Alstom Holdings, Paris (FR)

( * ) Notice: Subject to any disclaimer, the term of this patent is extended or adjusted under 35 U.S.C. 154(b) by 0 days.

(21) Appl. No.: 09/439,082

(22) Filed: Nov. 12, 1999

(30) Foreign Application Priority Data

Nov. 13, 1998 (FR) ..... 98 14289

(51) Int. Cl.[7] ..... B60N 2/14
(52) U.S. Cl. ..... 297/344.24; 297/232; 248/416
(58) Field of Search ..... 297/232, 344.21, 297/344.23, 344.24, 344.22; 248/131, 415, 416; 296/65.01

(56) References Cited

U.S. PATENT DOCUMENTS

| | | | | |
|---|---|---|---|---|
| 1,902,282 | | 3/1933 | Hultgren . | |
| 2,123,927 | * | 7/1938 | Bell | 248/416 |
| 2,147,953 | * | 10/1939 | Staveley | 248/416 |
| 2,183,021 | * | 12/1939 | Hill | 248/416 |
| 2,233,478 | * | 3/1941 | Hill | 248/416 |
| 2,301,279 | | 11/1942 | Hill . | |

FOREIGN PATENT DOCUMENTS

| | | | | |
|---|---|---|---|---|
| 355022562 | * | 2/1980 | (JP) | 297/344.21 |
| 406262971 | * | 9/1994 | (JP) | 297/344.24 |

* cited by examiner

*Primary Examiner*—Peter R. Brown
(74) *Attorney, Agent, or Firm*—Sughrue Mion, PLLC

(57) ABSTRACT

This seat comprises a mobile upper part (14) for accommodating at least one occupant, borne by a stationary lower part forming an underframe (16) and means (28) for turning the upper part (14) round to face the other way, and back again. These turning-round means (28) comprise a carriage (30), secured to the upper part (14), mounted so that it can be rotated about a roughly vertical axis (Z), connected with this carriage, and so that it can be moved in translation roughly at right angles to this axis of rotation (Z) in a straight guide (32) borne by the underframe (16). The turning-round means (28) also comprise means (52) for driving the translational movement of the carriage (30), and meshing means (54) for converting the translational movement of the carriage (30) into a rotational movement of this carriage (30).

10 Claims, 5 Drawing Sheets

MOTION ROTATING SEAT PARTICULARLY FOR A RAILWAY VEHICLE

BACKGROUND OF THE INVENTION

The present invention relates to an improved-motion rotating seat, particularly for a railway vehicle.

Already known in the state of the art is a seat of the type comprising a mobile upper part for accommodating at least one occupant, borne by a stationary lower part forming an underframe and means for turning the upper part round to face the other way, and back again.

Seats of this type are fitted, in particular, in railway vehicles. The means for turning a seat round allow this seat to be turned round to face the other way so that this seat and the passenger(s) occupying it, can face in the direction of travel of the vehicle, irrespective of the direction in which this vehicle is covering a route.

The seats of a railway vehicle are usually sited close to a left-hand or right-hand side wall of this vehicle.

As the space between the seats and the adjacent side wall is preferably as small as possible, the movement of turning a seat round to face the other way (and vice versa) simply by rotating the mobile upper part of the seat about a fixed vertical axis is impeded by the side wall. A seat is therefore generally turned around by first of all moving the mobile upper part away from the wall adjacent to the seat, and then by turning this mobile part about a vertical axis, and finally by bringing this mobile part back towards the wall adjacent to the seat.

SUMMARY OF THE INVENTION

The object of the invention is to provide a seat, particularly for a railway vehicle, which is equipped with compact, lightweight and easy-to-operate turning-round means so that all of the seats of a railway vehicle can quickly be turned round to face the other way.

To this end, the subject of the invention is a seat of the aforementioned type, characterized in that the turning-round means comprise a carriage, secured to the upper part, mounted so that it can be rotated about a roughly vertical axis, connected with this carriage, and so that it can be moved in translation roughly at right angles to this axis of rotation in a straight guide borne by the underframe, means for driving the translational movement of the carriage, and meshing means for converting the translational movement of the carriage into a rotational movement of this carriage.

According to other features of this seat:

the meshing means comprise a pinion which rotates as one with the carriage, the axis of which coincides with the axis of rotation of this carriage, which is intended to cooperate with a first or second rack borne by the underframe, depending on which of two opposite directions of translational movement the carriage is moving in during an operation of turning the upper part round, the two racks running more or less symmetrically with respect to a plane containing the axis of rotation of the carriage, on each side of the pinion;

the racks are borne by an assembly which is articulated about three axes approximately parallel to the axis of rotation of the carriage, each rack being placed selectively in a position in which it is in mesh with the pinion by causing one of the axes of articulation to pass through a position in which it is coplanar with the other two axes of articulation;

the assembly comprises a support bearing the two racks, this support being articulated to the underframe about a first axis of articulation, and a member for selecting one or other of the racks, which member is articulated to the underframe about a second axis of articulation, the support and the selection member being articulated to one another about the third axis of articulation which lies approximately between the other two axes of articulation;

the selection member comprises a first end forming a rocker which is articulated about the second axis of articulation, and a second end forming an elastically deformable shank which is articulated about the third axis of articulation, the rocker being intended to cooperate with a selection finger borne by the carriage;

the shank comprises a compression spring;

the selection finger is returned elastically to a position of rest in which its plane of symmetry is the plane containing the first and second axes of articulation, so that the selection finger can move on each side of this plane of symmetry, against the action of its elastic return force;

the drive means comprise a pull cable comprising one end connected to the carriage and one end connected to an operating lever articulated to the underframe;

the carriage is returned elastically to the position of rest against a first end of the guide, the underframe and the carriage having complementary shapes which prevent this carriage from rotating when it is in the position of rest, the immobilizing shape borne by the carriage having the axis of rotation of this carriage as its axis of symmetry.

Another subject of the invention is a railway vehicle comprising a seat as defined hereinabove.

BRIEF DESCRIPTION OF THE DRAWINGS

The invention will be better understood from reading the description which will follow, which is given merely by way of example and made with reference to the drawings, in which.

DETAILED DESCRIPTION OF THE INVENTION

Figure 1:
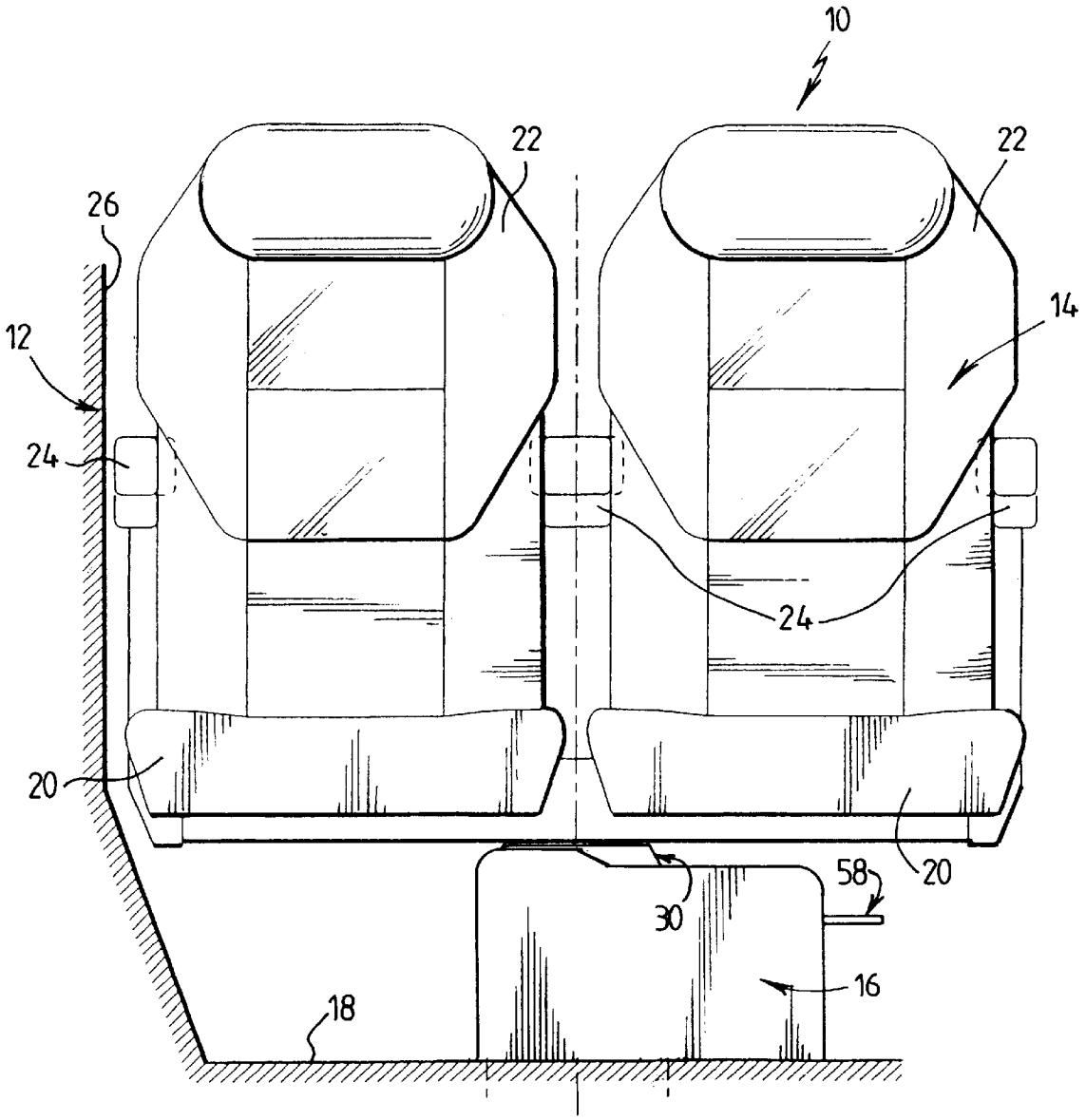
FIG. 1 is an elevation of a seat according to the invention.

FIG. 1 depicts a seat 10 according to the invention, fitted in a railway vehicle 12.

The seat 10 comprises a mobile upper part 14 borne by a stationary lower part 16 secured to a floor 18 of the vehicle 12. The upper part 14 is intended to accommodate at least one occupant, for example two occupants, as in the instance depicted in FIG. 1.

In the conventional way, the upper part 14 has seat cushion 20 and backrest 22 padding, and arm rests 24. The upper part 14 is arranged close to a side wall 26 of the vehicle 12.

The seat 10 also comprises means 28 for turning the upper part 14 round to face the other way, and back again. These turning-round means 28 which are illustrated in greater detail in FIGS. 2 to 9 allow the seat 10 to be placed in one or other of its two normal positions of use which are depicted in FIGS. 5 and 9.

The turning-round means 28 comprise a carriage 30 connecting the upper part 14 and the underframe 16 of the seat.

Figure 3:
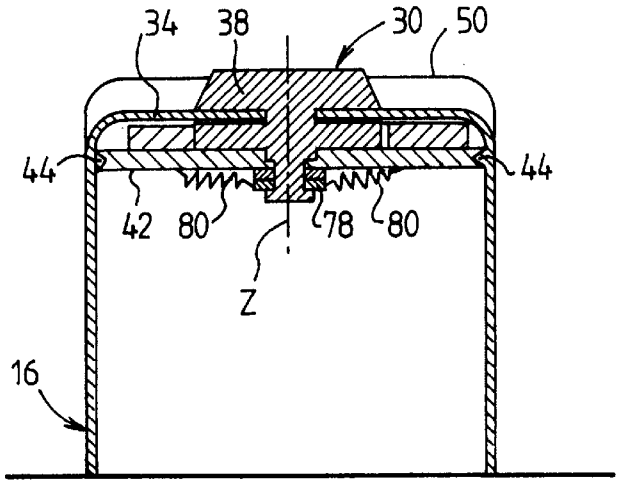
FIG. 3 is a view in section on the line 3—3 of FIG. 2.
Figure 2:
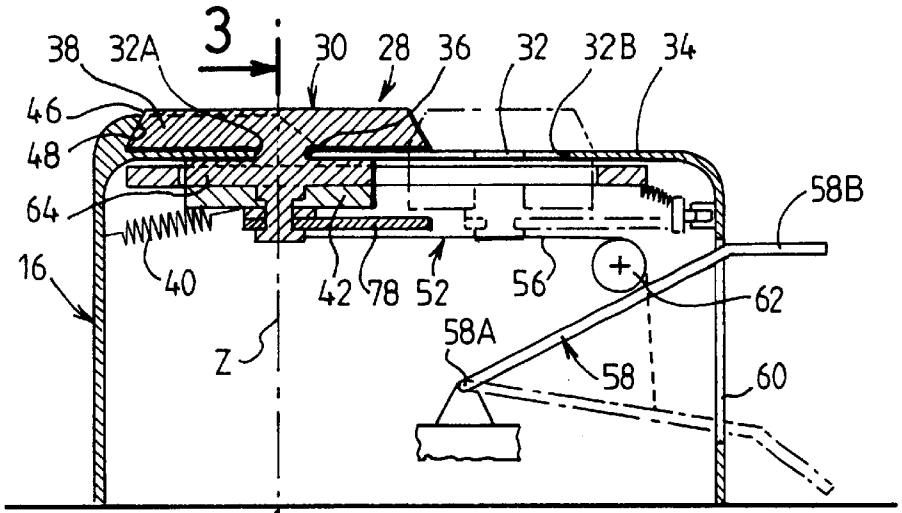
FIG. 2 is a view in section on a vertical plane through the underframe of the seat depicted in FIG. 1.
Figure 4:
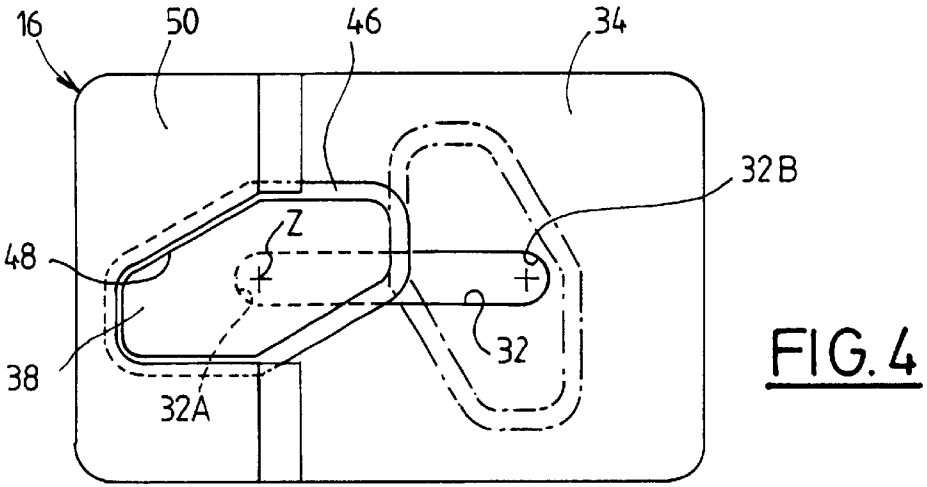
FIG. 4 is a view on FIG. 2 from above.
Figure 5:
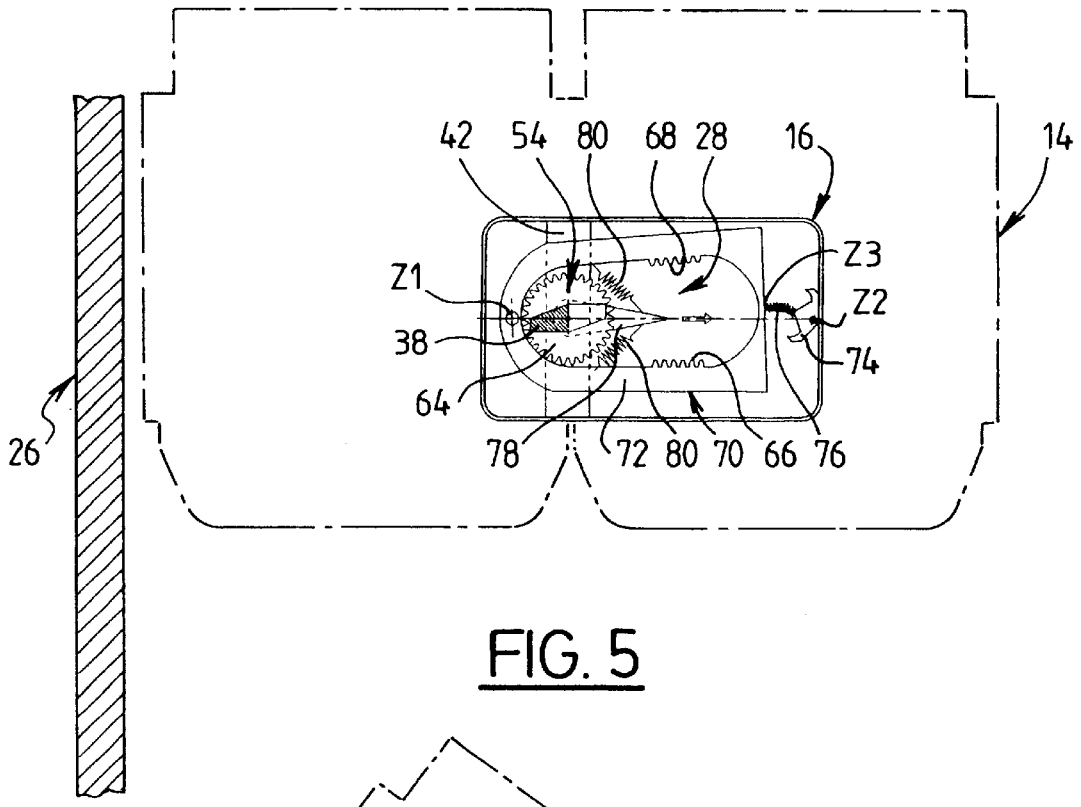
FIGS. 5 to 9 are diagrammatic views from above of the seat depicted in FIG. 1, showing this seat in successive positions during an operation of turning the seat round.

This carriage 30, secured to the upper part 14, is mounted so that it can be rotated about an approximately vertical axis Z, connected with this carriage, and moved in a translational movement approximately at right angles to this axis Z in a straight slot forming a guide 32 formed in an approximately horizontal wall 34 delimiting the underframe 16 (see, in particular, FIGS. 2 to 4).

The wall 34 divides the carriage 30 into two parts, one inside and one outside the underframe 16, these two parts being joined together by an intermediate part 36 forming a pivot of axis Z.

The guide 32 runs approximately parallel to a transverse vertical plane of the vehicle, such as the plane of FIG. 1.

The outer part of the carriage 30 forms a head 38 by means of which this carriage rests on the wall 34 of the underframe. The head 38 is in gliding contact with the wall 34.

The carriage 30 is returned elastically to the position of rest, against a first end 32A of the guide (to the left when considering FIG. 4) by a tension spring 40 attached to the underframe 16 and to the inner part of the carriage 30.

The first end 32A of the guide is the end closer to the side wall 26 of the vehicle, the wall adjacent to the seat, the second end 36B of the guide (to the right when considering FIG. 2) therefore being the end further from this side wall 26.

So that the carriage 30 can be guided in translational movement, the inner part of this carriage is mounted so that it can rotate about the axis Z, on a traverse 42 which slides on a pair of rails 44 approximately parallel to the guide 32. The rails 44, secured to the underframe 16, are formed, for example, inside this underframe 16, on approximately vertical walls delimiting the underframe 16 (see, in particular, FIGS. 2 and 3).

The underframe 16 and the carriage 30 comprise complementary shapes for preventing this carriage from rotating when it is in its position of rest as depicted, in particular, in FIGS. 2 and 4. In the example described, these complementary shapes are formed, one of them, 46, on the outline of the head 38 of the carriage and the other, 48, on a plinth 50 fitted to the wall 34. The complementary immobilizing surfaces 46,48 may advantageously be delimited by bevelled edges which help to vertically immobilize the carriage 30.

It will be noted that the immobilizing shape 46 formed on the head 38 of the carriage has the axis Z as its axis of symmetry.

The turning-round means 28 also comprise means 52 for driving the translational movement of the carriage 30 along the guide 32, these means being depicted in FIG. 2, and meshing means 54 for converting this translational movement into a rotational movement about the axis Z of the carriage 30, these means being depicted, in particular, in FIGS. 5 et seq.

In the example illustrated, the drive means 52 comprise a pull cable 56 comprising a first end connected to the lower part of the carriage 30 and a second end connected to an operating lever 58.

This operating lever 58 has a first, bearing end 58A articulated inside the underframe 16 about a geometric axis roughly perpendicular to the axis Z, and a second, operating end 58B extending out from the underframe 16 through an opening 60 therein.

It will be noted that the cable runs between the carriage 30 and the operating lever 58 over a turn pulley 62.

By depressing the operating lever 58 from its raised position depicted in solid line in FIG. 2, into its depressed position pictured in chain-line in FIG. 2, the carriage 30 is pulled using the cable 56 against the elastic return force of the spring 40 in such a way as to move this carriage 30 as far as the second end 32B of the guide.

The meshing means 54 comprise a toothed pinion 64, which rotates as one with the carriage 30, intended to cooperate with first and second racks 66,68 borne by an articulated assembly 70.

The pinion 64 borne by the inner part of the carriage 30 has an axis which coincides with the axis z.

The assembly 70 is articulated about 3 axes Z1 to Z3 approximately parallel to the axis Z. The assembly 70 comprises a frame forming a support 72, bearing the racks 66,68 and a member for selecting one or other of the racks, which member has a first end forming a rocker 74 and a second end forming an elastically deformable shank 76.

The frame 72 is articulated to the underframe 16 about the first axis of articulation Z1. The rocker 74 is also articulated to the underframe 16 about the second axis of articulation Z2. The shank 76 which, for example, consists of a compression spring, has one end for connecting to the rocker 74 and one end articulated to the frame 72 about the third axis of articulation Z3.

The third axis of articulation Z3 which connects the frame 72 and the selection member together, lies roughly between the other two axes of articulation Z1,Z2.

The racks 66,68 have teeth facing each other and are arranged more or less symmetrically with respect to a plane containing the axis Z, on each side of the pinion 64.

It will be noted that when the carriage 30 is in the position of rest, the pinion 64, housed inside the frame 72, is distant from the racks 66,68 (see FIG. 5).

The pinion 64 is intended to mesh with the first rack 66 when it moves in translation from the first end 32A towards the second end 32B of the guide and with the second rack 68 when it moves in the opposite direction, from the second end 32B towards the first end 32A of the guide.

It will be noted that when the carriage 30 moves from the first end 32A towards the second end 32B of the guide, it first of all experiences a simple translational movement and then experiences a translational movement combined with a rotational movement about the axis Z under the effect of the pinion 64 meshing with the first rack 66. This sequence of movements is reversed when the carriage is moved in the opposite direction, from the second end 32B towards the first end 32A of the guide.

Each rack 66,68 is selected in a position in which it is in mesh with the pinion 64 by causing the third axis of articulation Z3 to pass through a position in which it is coplanar with the other two axes of articulation Z1,Z2. This position is passed through by operating the selection member, more specifically the rocker 74 of this member, using a selection finger 78 borne by the carriage 30. The rocker 74 thus allows the frame 72 to be placed in two stable positions which are roughly symmetric with respect to the plane containing the first and second axes of articulation Z1,Z2.

Referring in particular to FIGS. 2, 3 and 5, it may be seen that the selection finger 78 is mounted so that it can pivot about the axis Z on the inner part of the carriage 30.

The selection finger 78 is returned elastically to a position of rest, as depicted in FIG. 5, by a pair of opposing tension springs 80 which connect with selection finger 78 to the sliding traverse 42. In the position of rest, the selection finger 78 has the plane containing the first and second axes of articulation Z1,Z2 as its plane of symmetry. The selection finger 78 can thus be moved on each side of this plane of symmetry against the elastic return force of one or other of the opposing springs 80.

The main stages involved in turning round the seat 10 according to the invention will be described hereinbelow with reference, in particular, to FIGS. 5 to 9.

Initially, the upper part 14 of the seat is in a first normal position of use of this seat as depicted in FIG. 5. The carriage is urged by the spring 40 against the first end 32A of the guide. The complementary shapes 46,48 for preventing the carriage from rotating are cooperating with each other. The operating lever 58 is in its raised position (see FIG. 2). The pinion 64 is distant from the racks 66,68.

To turn the seat 10 round, the operator depresses the operating lever 58 (preferably using his or her foot) against the return force of the spring 40, until this lever is in the depressed position depicted in chain-line in FIG. 2.

The depressing of the operating lever 58 has the effect of moving the carriage 30 in translation, approximately parallel to a transverse vertical plane of the vehicle 12, from the first end 32A of the guide towards its second end 32B.

This movement of the carriage 30 allows the upper part 14 to be moved away from the adjacent side wall 26.

Figure 6:
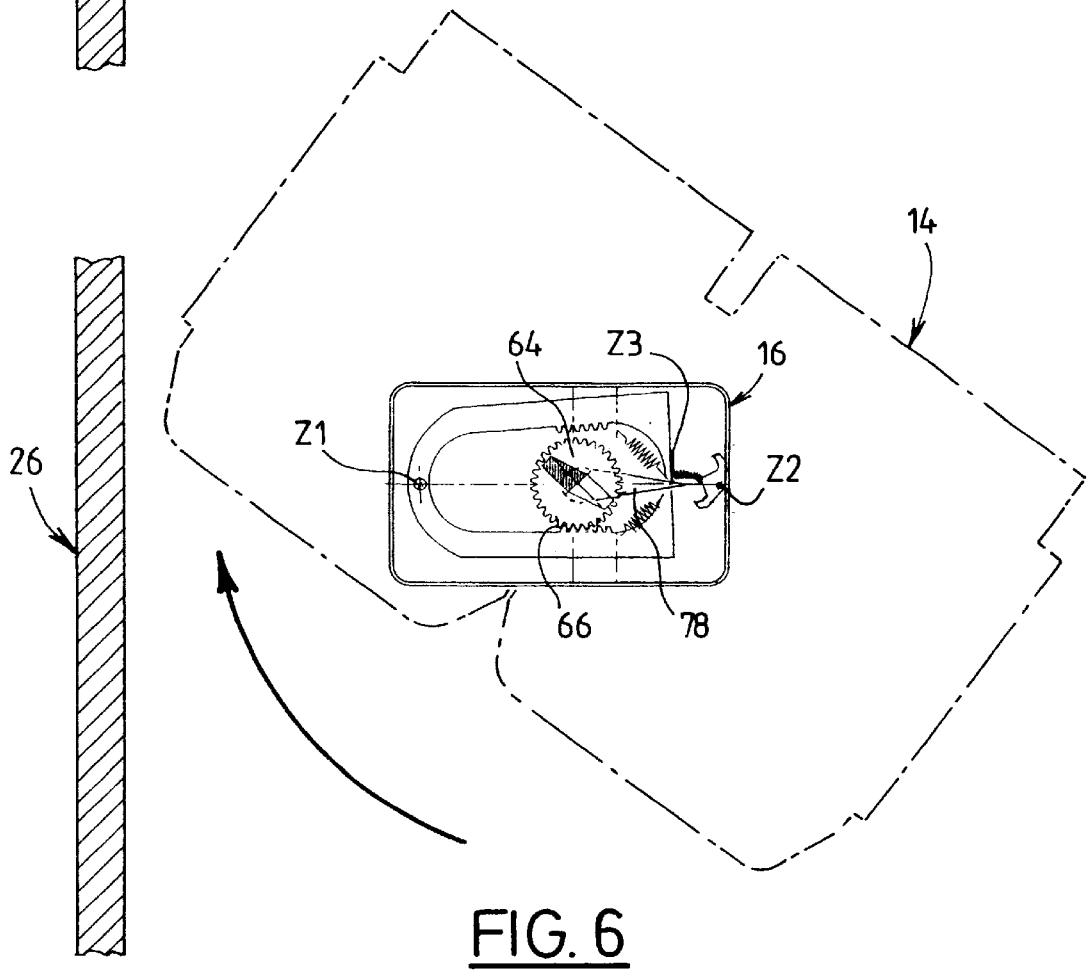

More or less mid-way between the two ends 32A,32B of the guide, the pinion 64 meshes with the first rack 66, and this has the effect of making the carriage 30 and the upper part 14 rotate about the axis Z, in the clockwise direction when considering FIG. 6.

Figure 7:
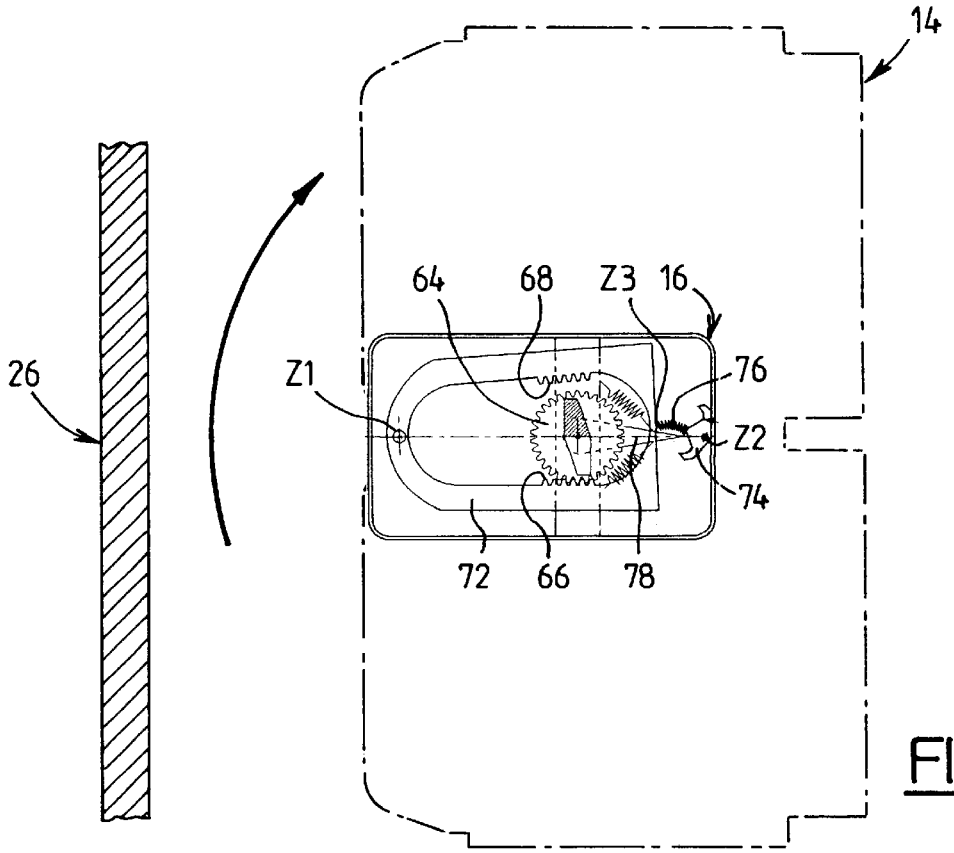
Figure 8:
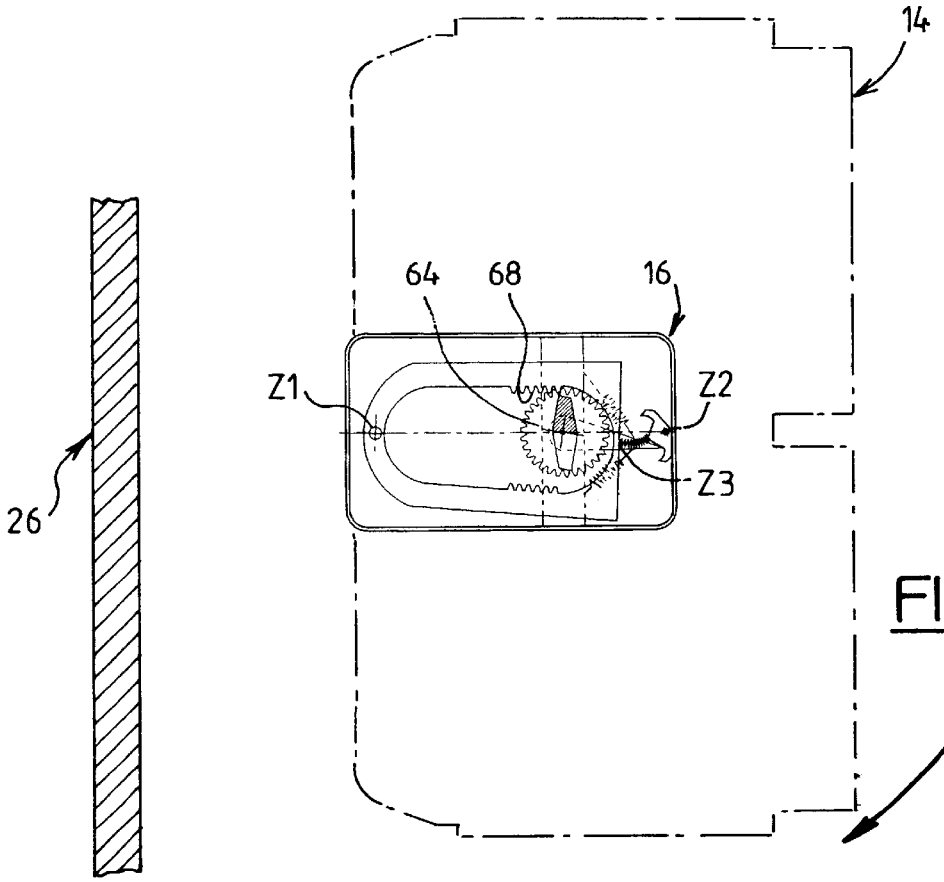
Figure 9:
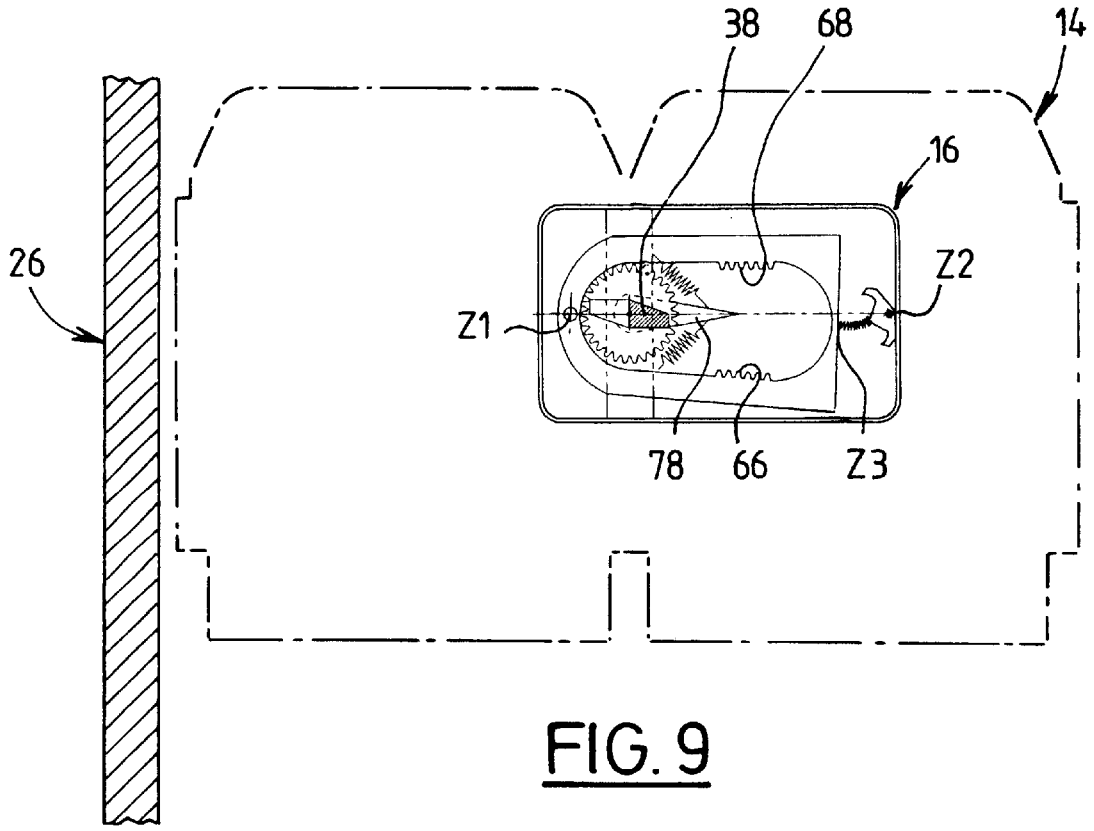

When the carriage 30 reaches the second end 32B of the guide, the selection finger 78 cooperates with a ramp of the rocker 74 to make the latter pivot about the axis Z2, as depicted in FIGS. 7 and 8. The pivoting of the rocker 74, which occurs against the elastic return force of the selection finger 78 (opposing springs 80), allows the third axis of articulation Z3 to pass through its position in which it is coplanar with the other two axes of articulation Z1,Z2 and thus cause the pinion 64 to mesh with the second rack 68.

It will be noted that when the carriage 30 has reached the second end 32B of the guide, the upper part 14 has turned approximately through a quarter of a turn, the operating lever 58 being in its depressed position as depicted in chain-line in FIG. 2.

The operator then releases the operating lever 58, so that the return spring 40, on the one hand, automatically returns the operating lever 58 to its raised position and, on the other hand, automatically returns the carriage 30 towards the first end 32A of the guide, in a translational movement that is the opposite of the one described previously.

The pinion 64, meshing with the second rack 68, drives the carriage 30 and the upper part 14 of the seat in rotation about the axis Z, still in the same clockwise direction when considering FIGS. 5 to 9. The pinion 64 cooperates with the second rack 68 until the upper part 14 of the seat has finished being turned round.

Once the turning-round operation has been completed, the carriage 30, still returned elastically by the spring 40, finishes its movement with a translational movement along the guide 32 as far as the first end 32A of this guide, so as to bring the upper part 14 of the seat closer to the side wall 26, so as to reach the second normal position of use of the seat which is depicted in FIG. 9.

In the latter position, the head 38, the axis of symmetry of which is the axis Z, once more cooperates with the plinth 50 to prevent the carriage 30 from rotating.

To return the seat to its position illustrated in FIG. 5, the operator moves the upper part 14 in a path which has to be the opposite of the one described earlier. Thus, when the upper part 14 and the underframe 16 of the seat are fitted with electric means (for example motorizing means intended to drive the upper part 14), there is no risk of any electric cables, that may be running between this part 14 and this underframe 16, accidentally becoming wound around the carriage 30 as a result of successive rotations of the upper part 14 always in the same direction.

Among the advantages of the invention, it will be noted that this invention allows an operator very easily to turn a seat round by driving the mobile upper part of this seat through a general turning-round movement using the lever 58, without this movement being impeded by the vehicle side wall close to the seat.

What is claimed is:

1. A seat comprising an upper part (14) for accommodating at least one occupant, carried by a lower part forming an underframe (16), and means (28) for turning the upper part (14) round to face the other way, and back again, wherein the turning-round means (28) comprise:

a carriage (30), carried by the upper part (14), and a straight guide (32) carried by the underframe, the carriage being movable with respect to the underframe in substantially horizontal translation in the straight guide, and the carriage being movable in rotation about a substantially vertical geometrical axis (Z) of rotation fixed with respect to the carriage when the carriage moves in translation in the straight guide, means (52) for driving the carriage (30) in translation in the straight guide, and meshing means (54) which comprise a first toothed part, carried by the upper part, and a second toothed part carried by the lower part, the first toothed part and the second toothed part meshing when the upper part moves in translation in the straight guide so as to impart a rotational movement of the carriage and of the upper part around the geometrical axis of rotation.

2. The seat according to claim 1, wherein the first toothed part comprises a pinion (64) which rotates as one with the carriage (30), and the second toothed part comprises a first and a second rack, the axis of the pinion coinciding with the geometrical axis (Z) of rotation, the pinion meshing with the first or the second rack (66,68), depending on which of two opposite directions the carriage (30) is moving in translation in the straight guide during an operation of turning the upper part (14) round, the first and second racks (66,68) extending substantially symmetrically with respect to a geometrical substantially vertical plane on each side of the pinion (60).

3. The seat according to claim 2, wherein the first and second racks (66,68) are carried by an assembly (70) which is articulated about three axes of articulation (Z1 to Z3) substantially parallel to the geometrical axis (Z) of rotation, each rack (66,68) being placed selectively in a position in which the rack is in mesh with the pinion (64) by causing one of the axes of articulation to pass through a position in which the one axis is coplanar with the other two axes of articulation.

4. The seat according to claim 3, wherein the assembly (70) comprises a support (72) carrying the first and second racks (66,68), said support being articulated to the underframe (16) about a first of said axes of articulation (Z1), the assembly further comprising a selection member (74,76) for selecting one or the other of the first and second racks (66,68), which selection member is articulated to the underframe (16) about a second of said axes of articulation (Z2), the support (72) and the selection member (74,76) being articulated to one another about a third of said axes of articulation (Z3) which lies substantially between the first and the second axes of articulation (Z1,Z2).

5. The seat according to claim 4, wherein the selection member comprises a first end forming a rocker (74) which is articulated about the second axis of articulation (Z2), and a second end forming an elastically deformable shank (76) which is articulated about the third axis of articulation (Z3), the rocker (74) being adapted to cooperate with a selection finger (78) carried by the carriage (30).

6. The seat according to claim 5, wherein the shank (76) comprises a compression spring.

7. The seat according to claim 5, wherein the selection finger (78) is movable on each side of a median plane containing the first and the second axes of articulation, and is elastically biased to a position of rest in which the selection finger is symmetrical with respect to the median plane.

8. The seat according to claim 1, wherein the driving means (52) comprise a pull cable (56) and an operating lever articulated to the underframe, the pull cable comprising one end, connected to the carriage (30), and another end connected to the operating lever (58).

9. The seat according to claim 1, wherein the carriage (30) is elastically biased to an end position in which the carriage bears on a first end (32A) of the straight guide, the underframe (16) having a first relief, and the carriage (30) having a second relief, the first and second reliefs being of complementary shapes (46,48) and preventing the carriage (30) from rotating when the carriage is in the end position, the second relief being symmetrical relative to the geometrical axis (Z) of rotation.

10. A seat according to claim 1 in a railway vehicle.

* * * * *